US005237728A

United States Patent [19]

Fudaki

[11] Patent Number: 5,237,728

[45] Date of Patent: Aug. 24, 1993

[54] BUCKLE ASSEMBLY

[75] Inventor: Tsutomu Fudaki, Kurobe, Japan

[73] Assignee: Yoshida Kogyo K. K., Tokyo, Japan

[21] Appl. No.: 993,032

[22] Filed: Dec. 18, 1992

[51] Int. Cl.[5] ..... A44B 11/00

[52] U.S. Cl. ..... 24/614; 24/616; 24/625; 24/573.1

[58] Field of Search ..... 24/614, 615, 616, 625, 24/633, 606, 573.1, 196, 662, 683

[56] References Cited

U.S. PATENT DOCUMENTS

| | | | |
|---|---|---|---|
| 4,679,282 | 7/1987 | Feng | 24/614 |
| 4,825,515 | 5/1989 | Wolterstorff, Jr. | 24/625 |
| 4,864,700 | 9/1989 | Kasai | 24/573.1 |
| 4,987,661 | 1/1991 | Kasai | 24/625 |

FOREIGN PATENT DOCUMENTS

| | | |
|---|---|---|
| 62-59425 | 4/1987 | Japan . |
| 2-28324 | 6/1990 | Japan . |

*Primary Examiner*—Victor N. Sakran
*Attorney, Agent, or Firm*—Hill, Steadman & Simpson

[57] ABSTRACT

A buckle assembly formed from a molded plastic material comprises a plug member and a socket member releasably engageable therewith, the plug member having a pair of spaced engaging tongues adapted to engage with corresponding flexural flanges of the socket member to urge the flanges to displace radially outwardly beyond the confines of lateral sides of the socket member. The plug member includes a locking prong resiliently movable into and out of a window formed in the socket member. A single hand manipulation of the locking prong and/or the flexural flanges facilitates resilient release of the plug member from the socket member.

5 Claims, 3 Drawing Sheets

BUCKLE ASSEMBLY

BACKGROUND OF THE INVENTION

1. Field of the Invention

This invention relates to a buckle assembly for releasably fastening a closure flap of a bag, rucksack and the like as well as for releasably connecting loose ends of a belt, strap and the like applied to trousers, sports wear and other garment articles.

2. Prior Art

A variety of buckle devices have heretofore been introduced for use in connecting and disconnecting mating loose ends of garment articles. Japanese Patent Publication No. 2-28324 discloses a center release type of buckle comprising a receptacle body and an insert body having a tongue portion slidably receivable in the receptacle body. A through aperture is formed substantially centrally in the upper surface of the receptacle body for receiving a raised portion of the receptacle body. The insert body is releasable from the insert body by depressing the tongue portion only from one direction. If the buckle is applied to easily deformable garment articles such as bags, trousers or the like, it would be difficult to release the insert body with a single hand and would be quite tedious to have to use both hands.

Another prior art buckle is disclosed in Japanese Laid-Open Utility Model Publication No. 62-59425 in which a plug body has a pair of inwardly directed projections engageable with a mating pair of arms formed in a receptacle body. The arms are resiliently deflectable and adapted to be depressed inwardly to cause the plug body to spring out. However, when the plug body is inserted half way or loosely into the receptacle body, it would be difficult to spring the plug out of the receptacle by manipulating the buckle with one hand due to insufficient resilient forces stored in the arms and would eventually require both hands to fully release the plug from the receptacle.

SUMMARY OF THE INVENTION

With the foregoing difficulties of the prior art in view, the present invention seeks to provide a buckle assembly which is simple in construction and reliable in operation. More specifically, the invention seeks to provide a buckle assembly comprising a plug member and a socket member and incorporating structural features such that the plug member can be released from the socket member by a single hand manipulation with utmost ease.

The buckle assembly of the invention has its plug member arranged to be released from its socket member simply by applying a finger pressure from above and/or from lateral sides of the buckle.

According to the invention, there is provided a buckle assembly which comprises a plug member and a socket member releasably engageable therewith, the plug member including a base, a pair of spaced resilient arms extending horizontally from and in parallel relation to the base, a locking prong integral with the arms, and a pair of spaced engaging tongues extending from the arms, and the socket member including an opening at one end, an upper plate and a lower plate connected by an end plate opposite to the opening and defining therebetween a chamber for receiving the plug member, and a pair of flexural flanges extending substantially over opposite sides of the socket member and having respective inwardly tapered portions normally urged inwardly toward each other and adapted to displace radially outwardly away from each other when brought into abutting engagement with the engaging tongues of the plug member.

The above and other features and advantages of the invention will be better understood from the following detailed description taken in connection with the accompanying drawings.

DETAILED DESCRIPTION OF THE INVENTION

Figure 1:
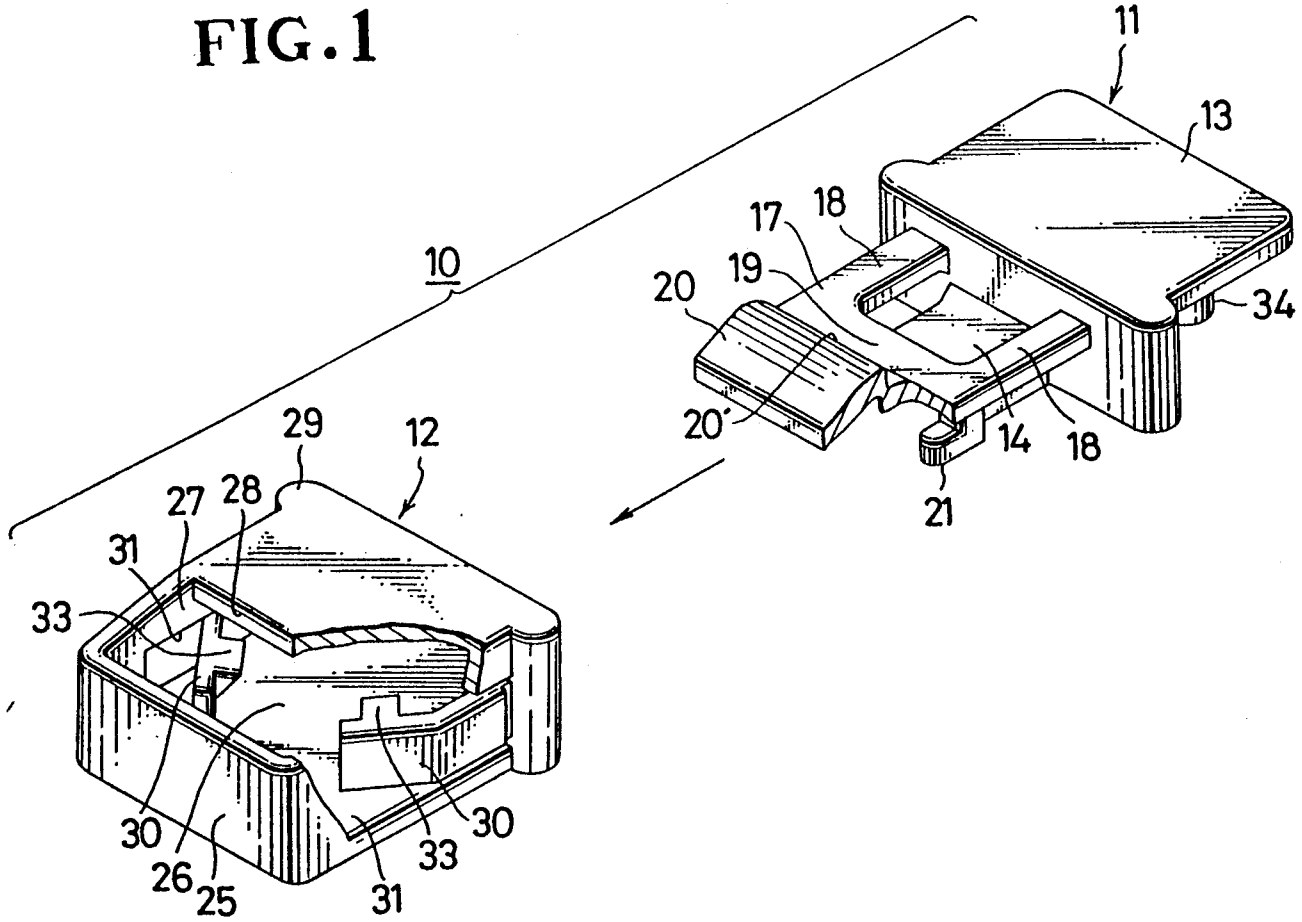
FIG. 1 is a perspective view, partly cut away, of a buckle assembly embodying the invention which comprises a plug member a socket member shown uncoupled.

Referring now to the drawings, there is shown a buckle assembly 10 embodying the invention which essentially comprises a male or plug member 11 and a female or socket member 12, the two members 11 and 12 being releasably engageable with each other generally in a manner well known in the art. The plug and socket members 11 and 12 are formed by molding a suitable plastics material into such respective configurations which will be hereinafter described.

The plug member 11 has a substantially rectangular base 13 having integrally formed therewith a guide shield 14 including a downwardly extending vertical portion 15 and a thickened horizontal portion 16 extending at a level below and parallel with the base 13 as better shown in FIG. 4, the guide shield 14 being slidably movable along the inner wall of a lower plate later described of the socket member 12. The plug member 11 has an engaging plate 17, the web of which is cut out to provide a pair of spaced horizontal resilient arms 18, 18 each connected at one end to the vertical portion 15 of the guide shield 14 and extending at a level slightly below the upper surface of the base 13 and substantially parallel with the horizontal portion 16 of the shield 14.

Removal thus of a substantial web portion of the engaging plate 17 results with the spaced arms 18, 18 being flexurally displaceable when the plug member 11 is inserted into the socket member 11 as later described. The opposite ends of the arms 18, 18 are connected integrally with a transverse beam 19.

A locking prong 20 is formed integrally with the transverse beam 19 and provided with a vertical abutment 20' projecting slightly above the transverse beam 19 for hooking engagement with the socket member 12 in a manner hereafter described. The locking prong 20 is dimensioned to terminate short of an inner wall of the socket member 12 when the latter has fully received the plug member 11 as shown in FIG. 6.

Figure 4:
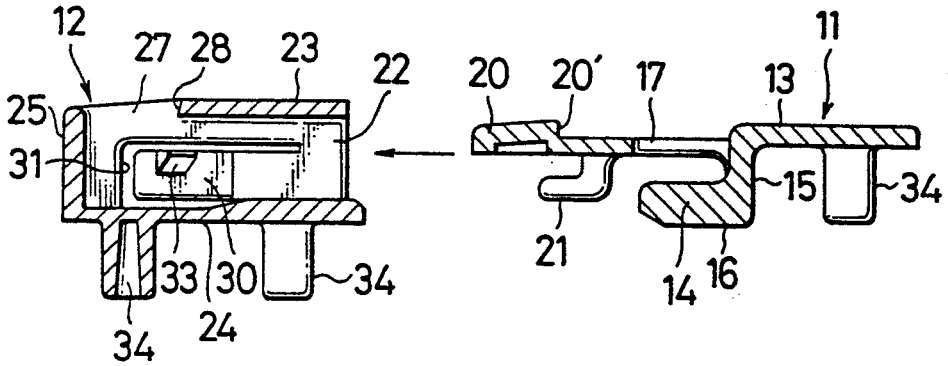
FIG. 4 is a longitudinal cross-sectional view of the buckle assembly in uncoupled condition.
Figure 5:
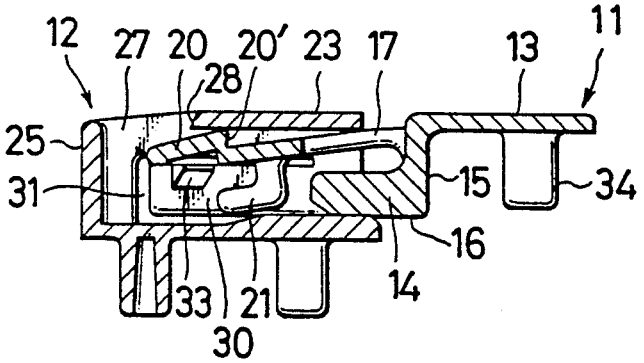
FIG. 5 is a longitudinal cross-sectional view of the buckle assembly shown in partially coupled condition.
Figure 6:
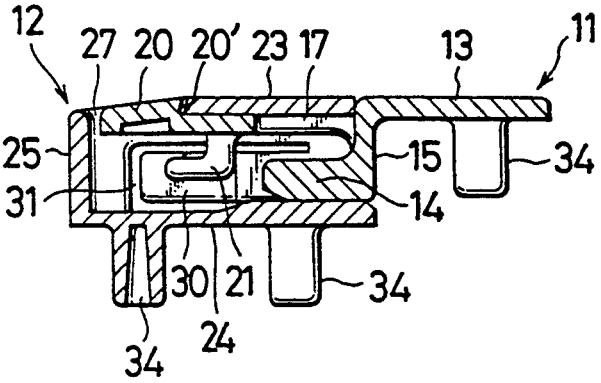
FIG. 6 is a longitudinal cross-sectional view of the buckle assembly shown in fully coupled condition.

The plug member 11 includes a pair of laterally spaced engaging tongues 21, 21 each extending downwardly from the transverse beam 19 and in parallel relation to the guide shield 14 and assuming a substantially inverted L-shape as seen in side elevation as shown in FIGS. 4–6 inclusive.

The socket member 12 is substantially in the form of a rectangular box, as depicted in FIG. 1, which has an opening 22 at one end for receiving the plug member 11 therethrough. The socket member 12 is formed by an upper plate 23 and a lower plate 24 which are connected at their one ends by an end plate 25 opposite to the opening 22, the plates 23 and 24 defining therebetween and jointly with the end plate 25 a chamber 26 for receiving the plug member 11 through the opening 22. The upper plate 23 is cut away to provide a square window 27 adjacent to the end plate 25 through which the locking prong 20 of the plug member 11 is exposed to view when the latter is fully engaged with the socket member 12, for which purpose the window 27 has an engaging rim 28 engageable with the vertical abutment 20' of the locking prong 20. The socket member 12 includes a pair of end posts 29 connecting the opposite ends of the upper and lower plates 23 and 24 at the opening 22. There are provided a pair of flexural flanges 30, 30 extending substantially over opposite sides of the socket member 12 and having their respective one ends connected to the end posts 29, 29 and their respective other ends freely movable through small apertures 31, 31 communicating with the chamber 26 adjacent to the end plate 25. The flanges 30, 30 have inwardly tapered portions 32, 32 with engaging lugs 33, 33 normally urged radially inward in confronting relation as better shown in FIG. 2. The engaging lugs 33, 33 are located in a position to register with the engaging tongues 21, 21 of the plug member 11.

Designated at 34 are connecting lugs formed at the bottom of each of the plug member 11 and the socket member 12 for mounting the buckle assembly 10 on a garment or the like not shown.

Figure 3:
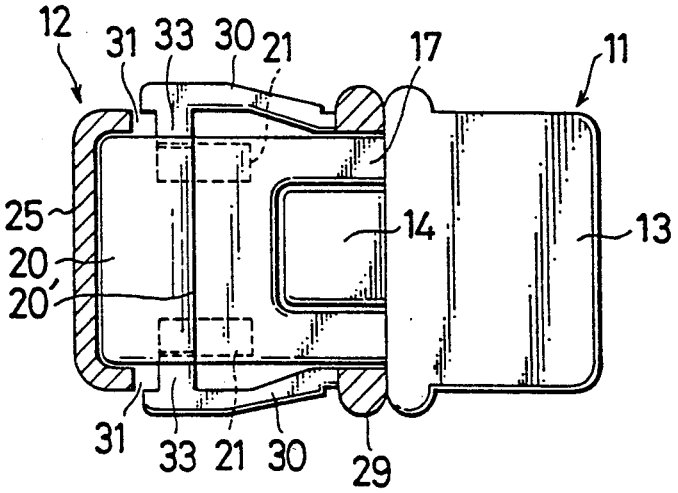
FIG. 3 is a plan view, partly cut away, of the buckle assembly shown in coupled condition.

With this construction, the buckle assembly 10 of the invention is coupled and uncoupled in use by bringing the plug member 11 into and out of engagement with the socket member 12. When coupling the two members together, this is done by inserting the plug member 11 with the guide shield 14 sliding forwardly along the inner wall of the lower plate 24 of the socket member 12 and with the locking prong 20 sliding in abutting contact with the inner wall of the upper plate 23 of the socket member 12 as the arms 18, 18 flex downwardly as illustrated in FIG. 5. The insertion of the plug member 11 is continued until the locking prong 20 is fully snappingly received in the window 27 with the vertical abutment 20' borne against the rim 28, in which instance the flexural flanges 30, 30 of the socket member 12 are urged to spread radially outwardly away from each other beyond the confines of the body of the socket member 12 as the engaging tongues 21, 21 of the plug member 11 progressively engage the corresponding engaging lugs 33, 33 as shown in FIGS. 5, 6 and 3.

Figure 2:
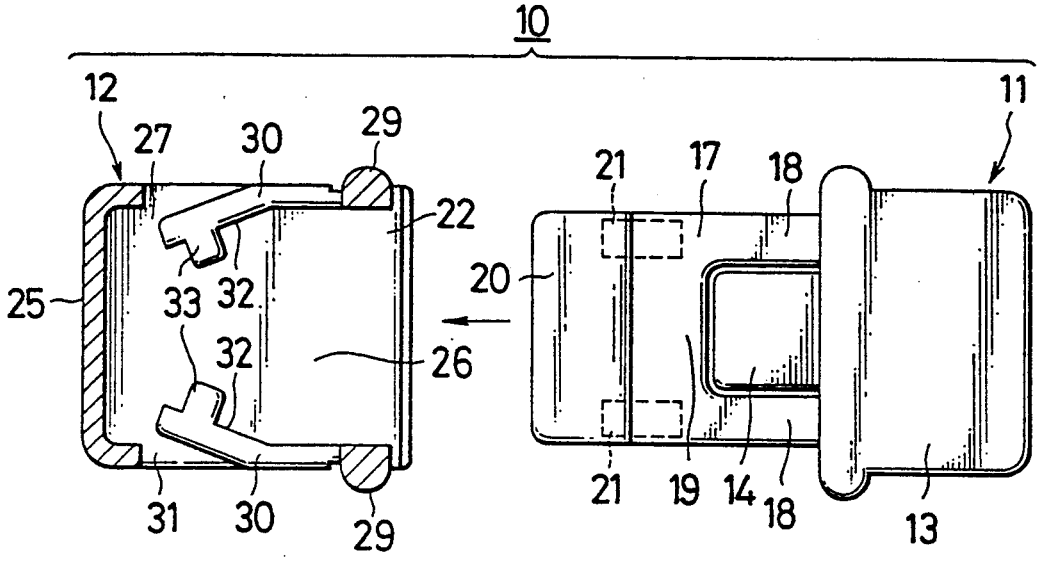
FIG. 2 is a plan view, partly cut away, of the same.

When uncoupling or separating the plug member 11 from the socket member 12, this is done simply by depressing the locking prong 20 to disengage its abutmemnt 20' from the rim 28 of the window 27, in which instance the engaging tongues 21, 21 of the plug member 11 are urged to retract toward the opening 22 by the resilient forces of the flexural flanges 30, 30 acting in a direction radially inward to return the flanges 30, 30 to their normal positions shown in FIG. 2. The plug member 11 can be thus easily pulled out and, if necessary, by further depressing the flexural flanges 30, 30 toward each other to spring the plug member 11 out of the socket member 12.

Obviously, various modifications and variations of the present invention are possible in the light of the above teaching. It is therefore to be understood that within the scope of the appended claims the invention may be practiced otherwise than as specifically described.

What is claimed is:

1. A buckle assembly which comprises a plug member and a socket member releasably engageable therewith, said plug member including a base, a resilient means, a locking prong integral with said resilient means, and an engaging tongue extending from said resilient means, and said socket member including an opening at one end, an upper plate and a lower plate connected by an end plate opposite to said opening and defining therebetween a chamber for receiving said plug member, said upper plate defining therein a window adjacent to said end plate for locking engagement with said locking prong, and a pair of flexural flanges extending substantially over opposite sides of said socket member and adapted to displace radially outwardly away from each other when brought into abutting engagement with said engaging tongue of said plug member.

2. A buckle assembly according to claim 1 wherein said resilient means is comprised of a pair of spaced resilient arms extending horizontally from and in parallel relation to said base.

3. A buckle assembly according to claim 1 wherein said flexural flanges have respective inwardly tapered portions normally urged inwardly toward each other.

4. A buckle assembly according to claim 1 wherein said engaging tongue assumes an inverted L-shape.

5. A buckle assembly according to claim 1 wherein said plug member further includes a guide shield extending at a level below and parallel with said base and slidably movable along the inner wall of said lower plate.

* * * * *